US009721692B2

(12) United States Patent
Jarvis

(10) Patent No.: US 9,721,692 B2
(45) Date of Patent: Aug. 1, 2017

(54) SYSTEM AND METHOD FOR GENERATING ELECTRICITY FROM RADIOACTIVE ISOTOPES

(71) Applicant: Denton Jarvis, Morgan, UT (US)

(72) Inventor: Denton Jarvis, Morgan, UT (US)

( * ) Notice: Subject to any disclaimer, the term of this patent is extended or adjusted under 35 U.S.C. 154(b) by 957 days.

(21) Appl. No.: 13/902,155

(22) Filed: May 24, 2013

(65) Prior Publication Data

US 2013/0313941 A1 Nov. 28, 2013

Related U.S. Application Data

(60) Provisional application No. 61/651,260, filed on May 24, 2012.

(51) Int. Cl.
*G21H 1/00* (2006.01)

(52) U.S. Cl.
CPC ..... *G21H 1/00* (2013.01)

(58) Field of Classification Search
CPC ..... G21H 1/00; G21H 1/02; G21H 1/06
USPC ..... 310/301, 305; 976/DIG. 410–DIG. 411; 977/948–950, 954; 376/113
See application file for complete search history.

(56) References Cited

U.S. PATENT DOCUMENTS 4,086,375 A * 4/1978 LaChapelle, Jr. ..... H01L 21/033 216/102
5,111,099 A * 5/1992 Smith ..... G21H 1/00 136/202
5,260,621 A * 11/1993 Little ..... G21H 1/103 136/202
7,837,813 B1 11/2010 Barker
2002/0159943 A1 10/2002 Smalley
2005/0082942 A1* 4/2005 Shirley ..... G21H 1/00 310/303
2010/0035061 A1 2/2010 Mason
2010/0193695 A1* 8/2010 Yeow ..... G01T 1/026 250/370.07
2010/0304218 A1 12/2010 Barker
2012/0152725 A1 6/2012 Barker
2012/0163547 A1 6/2012 Lee

OTHER PUBLICATIONS

Wang et al., The Rare Two-Dimensional Materials With DIRAC Cones, 2015, Natl. Sci. Rev. 2(1), pp. 1-31.*
Wikipedia,Radioisotope piezoelectric generator, Jul. 19, 2010, <http://en.wikipedia.org/wiki/Radioisotope_piezoelectric_generator>.

(Continued)

*Primary Examiner* — Quyen Leung
*Assistant Examiner* — Eric Johnson
(74) *Attorney, Agent, or Firm* — Morriss O'Bryant Compagni, PC

(57) ABSTRACT

A system and method for generating electricity by combining a fuel core and a drive regulation and containment system, the fuel core having a plurality of radioactive isotopes disposed between a plurality of crystalline lattices, and the drive regulation and containment system having a plurality of electromagnets that concentrate charged particles generated in the fuel core from the plurality of radioactive isotopes, and an electric field generated by an electron flow initiation system for driving the charged particles through the fuel core to create a current flow.

17 Claims, 7 Drawing Sheets

(56) References Cited

OTHER PUBLICATIONS

Korea Advanced Institute of Science and Technology (KAIST), Power generation technology based on piezoelectric nanocomposite materials, Advanced Materials Journal, May online issue, May 7, 2012,<http://phys.org/news/2012-05-power-technology-based-piezoelectric-nanocomposite.html>.
Cox, Lauren, Manufacturers Turn to 3-D Printing, MIT Technology Review, Jul. 18, 2011, <http://www.technologyreview.com/business/38060/manufacturers-turn-to-3-d-printing/>.
Lapin, Andrew, Most federal energy initiatives come from four agencies, GAO finds, Government Executive, Mar. 13, 2012, <http://www.govexec.com/management/2012/03/most-federal-energy-initiatives-come-four-agencies-gao-finds/41450/>.
Gallagher, Sean, New 3D printer could create nano-devices in minutes, Ars Technica, Mar. 13, 2012, <http://arstechnica.com/business/2012/03/new-3d-printer-could-create-nano-devices-in-minutes/>.
Case Western Reserve University, Researchers find simple and cheap way to mass-produce graphene nanosheets, Phys.org, Mar. 26, 2012, <http://phys.org/news/2012-03-simple-cheap-mass-produce-graphene-nanosheets.html>.
Bourzac, Katherine, Tomorrow's Transistor, Built Atom by Atom, MIT Technology Review, Jul. 14, 2011, <http://www.technologyreview.com/energy/38031/tomorrows-transistor-built-atom-by-atom/?p1=MstRcnt>.
American Institute of Physics, Writing graphene circuitry with ion 'pens', Phys.Org, Mar. 27, 2012, <http://phys.org/news/2012-03-graphene-circuitry-ion-pens.html>.
Sandia National Laboratories, Neutron generation: Going from tubes to chips, Phys.Org, Apr. 17, 2012, <http://phys.org/news/2012-04-neutron-tubes-chips.html.
University of Arkansas, New method offers control of strain on graphene membranes, Phys.Org, Apr. 2, 2012, <http://phys.org/news/2012-04-method-strain-graphene-membranes.html>.
Hunt, Lauren L., University of Wisconsin-Milwaukee, UWM discovery advances graphene-based electronics, Phys. Org, Apr. 16, 2012, <http://phys.org/news/2012-04-uwm-discovery-advances-graphene-based-electronics.html>.
University of Glasgow, New 3D printing process could leady to DIY drugstores, Phys.Org, Apr. 16, 2012, <http://phys.org/news/2012-04-3d-diy-drugstores.html>.
Shurkin, Joel N., Will 3D printing launch a new industrial revolution?, Inside Science News Service, Phys.Org, Apr. 13, 2012, <http://phys.org/news/2012-04-d-industrial-revolution.html>.
Taylor, Kate, New process promises cheap, flexible electronics, TG Daily, Apr. 20, 2012, <http://www.tgdaily.com/trendwatch-features/62861-new-process-promises-cheap-flexible-electronics>.
Yirka, Bob, Research team uses nanoparticles to make paper waterproof and magnetic, Phys.Org, Apr. 20, 2012, <http://phys.org/news/2012-04-team-nanoparticles-paper-waterproof-magnetic.html>.
Vanderbilt University, Barrier to faster graphene devices identified and suppressed, Mar. 13, 2012, <http://phys.org/news/2012-03-barrier-faster-graphene-devices-suppressed.html>.
Bourzac, Katherine, Making Stuff with Molecular Precision, Technology Review, Jul. 21, 2011, <http://www. technologyreview.com/news/424758/making-stuff-with-molecular-precision/>.
Woollacott, Emma, 3D printer knocks out tiny objects—fast, TG Daily, Mar. 12, 2012, <http://www.tgdaily.com/trendwatch-features/62014-3d-printer-knocks-out-tiny-objects-fast>.
Betancourt, Gaspar, 3D Printing: Billion Dollar Industry Almost Ready to Go Mainstream, WB Engineering, Jan. 5, 2012, <http://wb-3d.com/2012/01/3d-printing-is-a-billion-dollar-industry-and-is-almost-ready-to-explode-into-the-mainstream/>.
Clancy, Heather, 5 renewable energy trends to watch in 2012, ZD Net, Mar. 13, 2012, <http://www.zdnet.com/blog/green/5-renewable-energy-trends-to-watch-in-2012/20674>.
Chandler, David L., New material shares many of graphene's unusual properties, MIT News, Apr. 25, 2012, <http://web.mit.edu/newsoffice/2012/dirac-cones-graphene-bismuth-antimony-0424.html>.
Goodrich, Marcia, Graphene boosts efficiency of next-gen solar cells, Phys.Org, Apr. 24, 2012, <http://phys.org/news/2012-04-graphene-boosts-efficiency-next-gen-solar.html>.
Yirka, Bob, Computer simulations suggest graphynes may be even more useful than graphene, Phys.Org, Mar. 5, 2012, <http://phys.org/news/2012-03-simulations-graphynes-graphene.html>.
Rensselaer Polytechnic Institute, New graphene discovery boosts oil exploration efforts, could enable self-powered microsensors, Phys.Org, Jul. 19, 2011, <http://phys.org/news/2011-07-graphene-discovery-boosts-oil-exploration.html>.
Bhowmick, Somnath & Sadrzadeh, Arta, Rice University, Two-dimensional boron has potential advantages over graphene, Phys. Org, Apr. 23, 2012, <http://phys.org/news/2012-04-two-dimensional-boron-potential-advantages-graphene.html>.
Duke University, Creating nanostructures from the bottom up, Phys.Org, Apr. 24, 2012, <http://phys.org/news/2012-04-nanostructures-bottom.html>.

* cited by examiner

SYSTEM AND METHOD FOR GENERATING ELECTRICITY FROM RADIOACTIVE ISOTOPES

BRIEF SUMMARY

The present invention is a system and method for generating electricity by combining a fuel core and a drive regulation and containment system, the fuel core having a plurality of radioactive isotopes disposed between a plurality of crystalline lattices, and the drive regulation and containment system having a plurality of electromagnets that concentrate charged particles generated in the fuel core from the plurality of radioactive isotopes, and an electric field generated by an electron flow initiation system for driving the charged particles through the fuel core to create a current flow.

These and other embodiments of the present invention will become apparent to those skilled in the art from a consideration of the following detailed description taken in combination with the accompanying drawings.

DETAILED DESCRIPTION

Reference will now be made to the drawings in which the various embodiments of the present invention will be given numerical designations and in which the embodiments will be discussed so as to enable one skilled in the art to make and use the invention. It is to be understood that the following description illustrates embodiments of the present invention, and should not be viewed as narrowing the claims which follow.

Figure 1:
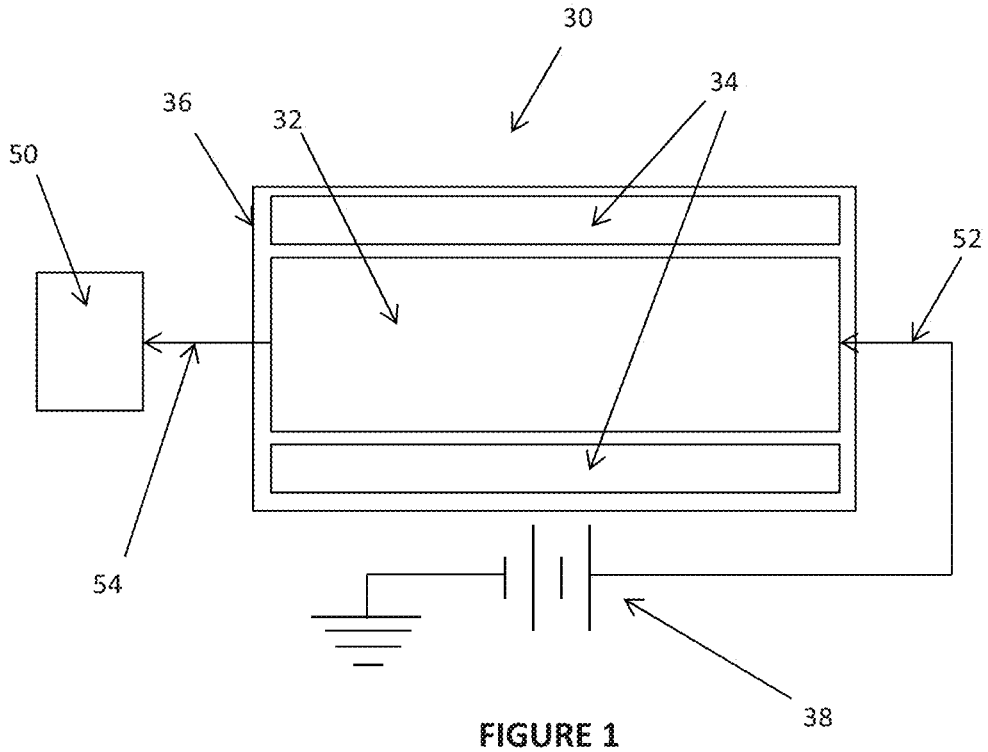
FIG. 1 is a cut-away profile view of a first embodiment of an energy generating system, including a fuel core and drive and containment system.

FIG. 1 is a cut-away profile view of a first embodiment of a system and method for generating electricity from the radioactive decay of radioactive isotopes. The energy generating system 30 may be comprised of a fuel core 32, a drive regulation and containment system 34 and a housing 36. Coupled to the fuel core 32 is an energy flow or electron flow initiation system 38. The electron flow initiation system 38 may be used to start the flow of electrons from the fuel core 32 and provide power to an electrical load or system 50.

The electron flow initiation system 38 may also affect a rate of the flow of electrons from the fuel core 32.

The direction of travel of electrons into the fuel core 32 is indicated by the arrow 52, and out of the fuel core by the arrow 54. The electron flow initiation system 38 may be any power source that provides an electric field through the fuel core 32. It should be understood that the power required to initiate electron flow through the fuel core 32 is very small compared to the electron flow from the fuel core.

The components shown in figure are for illustration purposes only and should not be considered to be limiting the structure of the energy generating system 30. The energy generating system 30 may be modified without departing from the inventive aspects of the present invention. The exact size of the components, the relative size of the components, the spacing between the components and the precise shape of the components may be modified from what is shown and still fall within the inventive aspects of the disclosure.

Figure 2:
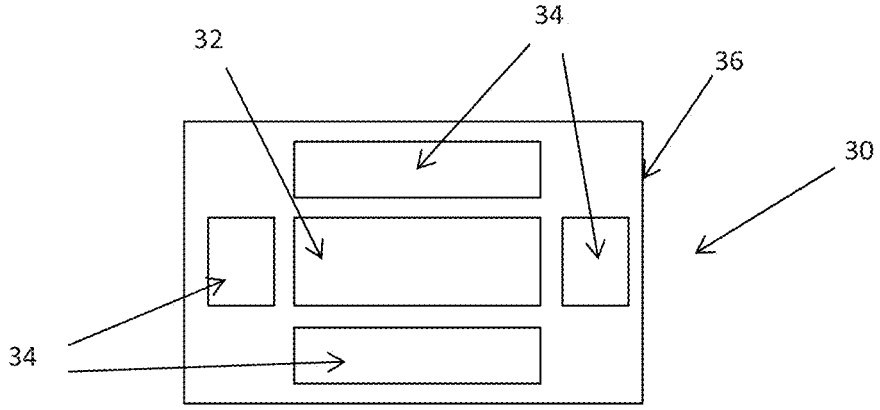
FIG. 2 is a cut-away profile end view of the energy generating system of FIG. 1.

FIG. 2 is a cut-away profile end view of the energy generating system 30 of FIG. 1. The end view shows that components of the drive regulation and containment system 34 are disposed on all sides of the fuel core 32. An explanation of the components of the energy generating system 30 now follows.

Figure 3:
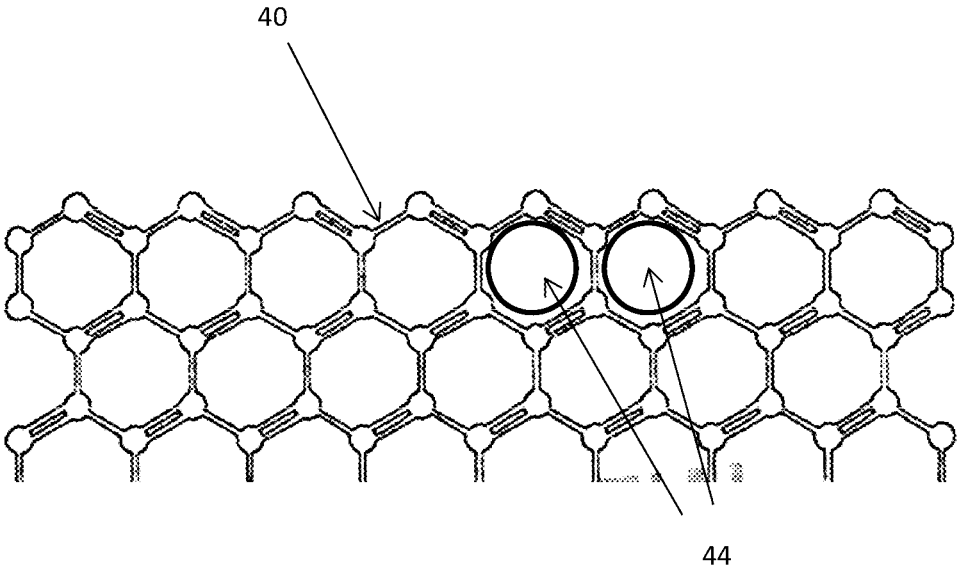
FIG. 3 is a top view of a single layer of a crystalline lattice.

FIG. 3 is a top view of a first embodiment of a component of the fuel core 32. In this first embodiment, the fuel core 32 may be comprised of a crystalline lattice and a plurality of radioactive isotopes 44. FIG. 3 is a top view of a portion of one possible shape of a crystalline lattice 40. The crystalline lattice 40 may have properties that enable it to absorb charged particles from the energy released by the radioactive decay from the plurality of radioactive isotopes 44 in the fuel core 32. The crystalline lattice 40 may also function as a frame for holding the plurality of radioactive isotopes 44.

The crystalline lattice 40 shown in FIG. 3 may be a crystalline lattice 40 formed from Graphene, with edges of the six sided lattice structures being approximately 0.35 nm. However, this size limitation should not be considered as limiting. The lattice structure of other materials may be different, but may be within an order of magnitude of these dimensions.

Figure 4:
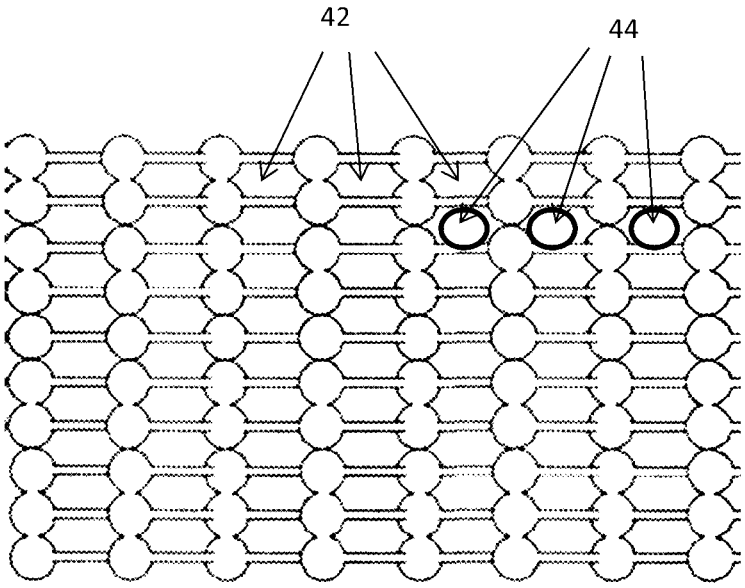
FIG. 4 is a profile view of a plurality of crystalline lattices forming a multi-layer design for a fuel core.

FIG. 4 is a cut-away profile view of a stack of the crystalline lattices 40. The stack of the crystalline lattices 40 creates locations 42 in which the plurality of radioactive isotopes 44 may be disposed between the layers of the stack. Thus, the size and shape of the locations 42 may be increased or decreased as necessary in order to properly hold the radioactive isotopes that are selected for use on the fuel core 32. It should be understood that the plurality of radioactive isotopes 44 may or may not fill all of the locations 42 in the stack of the crystalline lattices 40.

The stack of the crystalline lattices 40 may be formed into a plurality of layers for holding the plurality of radioactive isotopes 44, but also for absorbing charged particles that are emitted from the plurality of radioactive isotopes. The crystalline lattice 40 may undergo absorption of alpha and beta radiation and free electrons given off by the decay of the plurality of radioactive isotopes 44.

The charged particles may be positively or negatively charged. For example, the charged particles may be positrons or electrons (referred to hereinafter only as "electrons"). The different layers of the crystalline lattices 40 may not touch each other, but may instead be kept apart by the source of charged particles (the plurality of radioactive isotopes 44).

The shape of the fuel core 32 may be any two-dimensional or three-dimensional shape that provides the desired function. Some shapes may make containment more convenient or increase current flow for a given volume of space. For example, the cross-section of the fuel core 32 may be triangular, rectangular or circular, or it may not be limited to any of these shapes.

The crystalline lattices 40 may have Dirac properties. For example, the crystalline lattices 40 may take the form of Dirac cones. Dirac cones are features in the band structure of a two-dimensional material where the conduction and valence bands meet in a single point in the Fermi level. The bands approach this point in a linear way, meaning that the effective kinetic energies of the conduction electrons (and holes) are directly proportional to their momenta. This unusual relationship is normally only seen for photons, which are massless, because the energies of the electrons and other particles of matter at non-relativistic velocities usually depend on the square of their momenta. The result is that the electrons in the Dirac cones may behave as though they are relativistic particles with no rest mass, traveling through the material at extremely high speeds.

The crystalline lattices 40 with Dirac cone properties may absorb the free-flowing electrons that are available from the active particles source (the plurality of radioactive isotopes 44). The crystalline lattices 40 may have near lossless properties (lossless conductivity of particles) and may possess favorable electrical and thermal conductive properties. The active particle source may supply an excess amount of electrons while the crystalline lattices 40 may provide a structure to harvest the available free electrons.

A source of charged or active particles may be associated with any type of radioactive isotopes. For example, Strontium-90 has both high beta radiation and elevated electron activity, and may be used as the active particle source. However, Strontium-90 is only an example and should not be considered as limiting of the different radioactive isotopes that may be used in the fuel core 32 of the present invention.

Another feature of the crystalline lattices 40 of the fuel core 32 is that they may be scalable. A scalable structure for the crystalline lattices 40 may enable the amount of current flow and thus the total amount of electricity to be generated from the fuel core 32 to substantially vary. Thus the number of layers in the stack of the crystalline lattices 40 may be increased or decreased, or the very structure such as the size of the locations 42 in the crystalline lattices 40 may be increased or decreased.

Examples of materials having Dirac crystalline lattice structures include, but should not be considered as limited to, Graphene, Bismuth-Antimony and Boron. However, any material may be used for the crystalline lattices 40 that can provide the desired features of the fuel core 32.

The housing 36 of the energy generating system 30 may help to contain the decay reaction of the plurality of radioactive isotopes 44, it may contain a pressure within the fuel core 32, or it may do both functions. The electron flow initiation system 38 may pass through the housing 36 in order to gain access to the fuel core 32.

The drive regulation and containment system 34 of the energy generating system 30 enables the charged particles in the stack of crystalline lattices 40 to be moved through the lattice structure, thereby creating current flow and the generation of electricity.

The drive regulation and containment system 34 may be comprised of a plurality of magnets as shown in FIGS. 1 and 2. The plurality of magnets 34 may be used to control a direction of current flow through the fuel core 32, as well as a rate at which the current flows through the fuel core. The plurality of magnets 34 may be permanent which may make it difficult to control current flow. Accordingly, a plurality of electromagnets 34 may enable control of current flow. It may also be possible to use a combination of permanent and electromagnets as the drive regulation and containment system 34.

The plurality of magnets, permanent and/or electromagnetic, may be configured around a perimeter of the fuel core 32. With the plurality of magnets 34 on all sides of the fuel core 32, the charged particles may be compressed into a center of the fuel core. The charged particles may form a shape that is determined by the magnetic field lines of the plurality of magnets 34. Thus if the plurality of magnets 34 are in a linear arrangement along a length of the fuel core 32 as shown in FIG. 1, the charged particles may be formed into a linear arrangement. This arrangement of charged particles may be referred to herein as a tunnel. The tunnel may or may not be linear in shape.

An example of a specific geometry for the plurality of magnets 34 is a quadrupole design as known to those skilled in the art. One example of a quadrupole is shown in FIGS. 1 and 2. However, the plurality of magnets 34 is not limited to this structure as will be shown.

Figure 5:
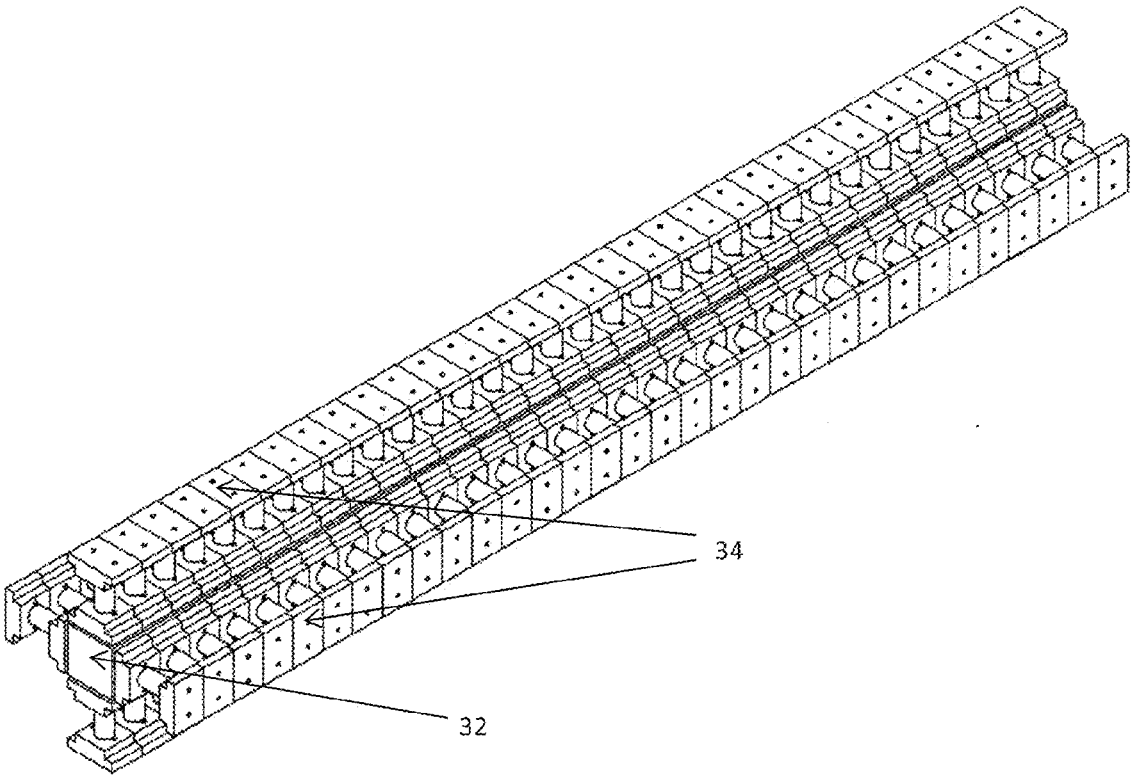
FIG. 5 is a perspective view of a fuel core surrounded by a plurality of electromagnets.

FIG. 5 is a more detailed perspective view of a plurality of electromagnets 34 that are disposed around the fuel core 32. This figure is an illustration of a linear fuel core 32 and drive regulation and containment system 34. Just as an example of the size of the structure being shown, the length of the fuel core 32 and the plurality of electromagnets 34 around the fuel core is approximately 1.5 feet. However, these dimensions shown are for illustration purposes only, and should not be considered as limiting. The dimensions of the energy generating system 30 may vary greatly because of the scalability of the system. Thus, the length of the energy generating system 30 may be less than one inch or may be greater than 10 feet without departing from the teachings of the present invention.

Figure 6:
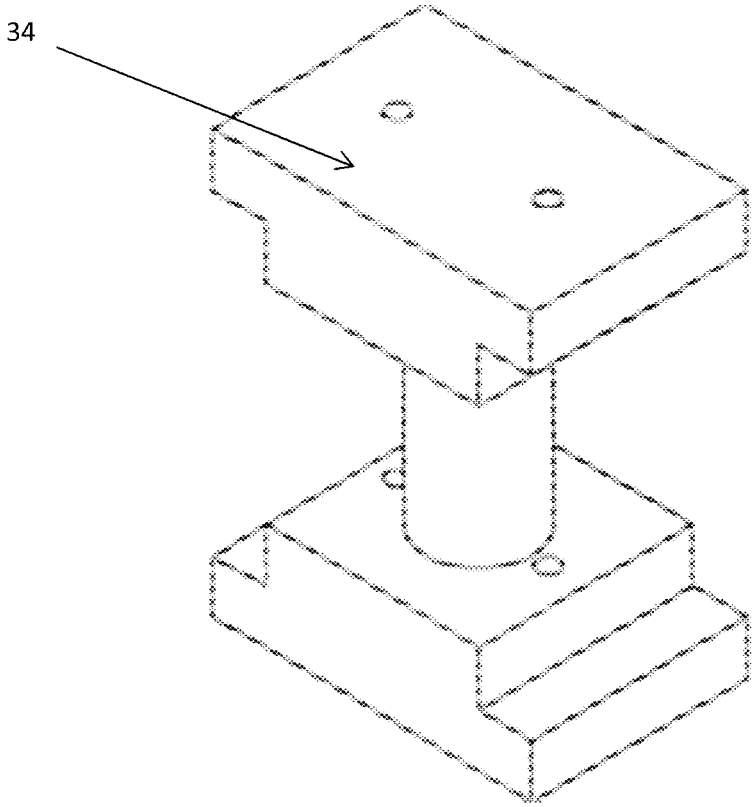
FIG. 6 is a perspective view of a single electromagnet of a plurality of electromagnets that form a drive and containment system.

FIG. 6 is a detailed and close-up perspective view of a single one of the plurality of electromagnets 34 that may be used to create the drive regulation and containment system shown in FIG. 5. This figure is for illustration purposes only and should not be considered as limiting of the shape of the electromagnets.

Figure 7:
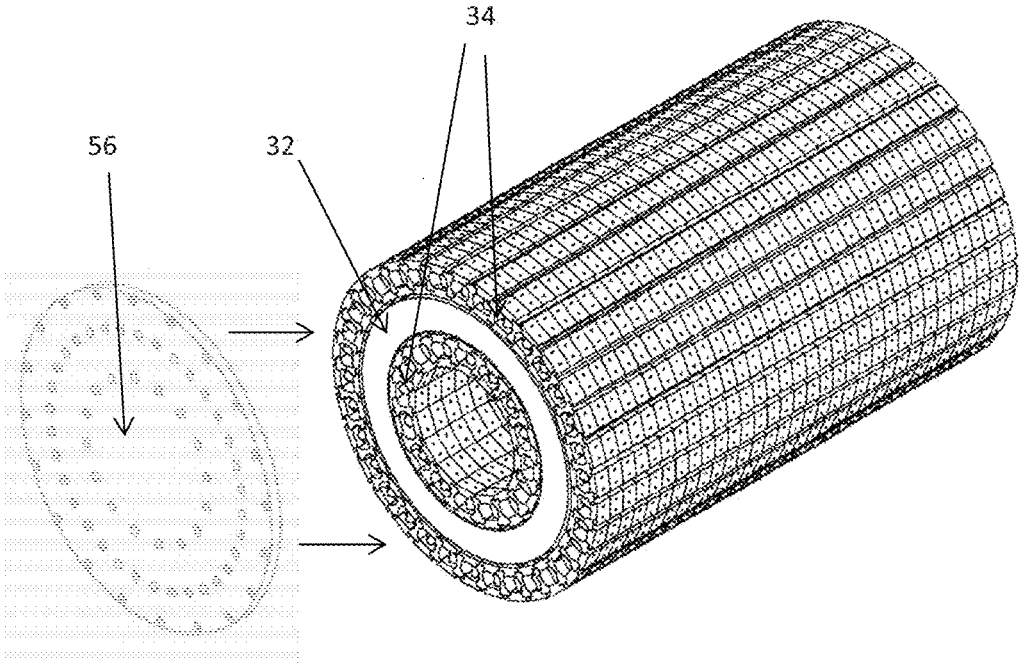
FIG. 7 is a perspective view of a cylindrical design of an energy generating system including a fuel core and an electromagnetic drive and containment system.

FIG. 7 is a perspective view of another embodiment of a fuel core 32 and drive regulation and containment system 34 of the energy generating system 30. The fuel core 32 and the plurality of electromagnets 34 may be cylindrical as shown. The fuel core 32 is shown as a cylindrical tube disposed between an outer layer of electromagnets 34 and an inner layer of electromagnets. In all embodiments, it is presumed that an end cap 56 may be disposed at both ends of the fuel core 32 and the plurality of electromagnets 34. The end cap 56 may be part of the containment system 36 or it may be a separate component.

Figure 8:
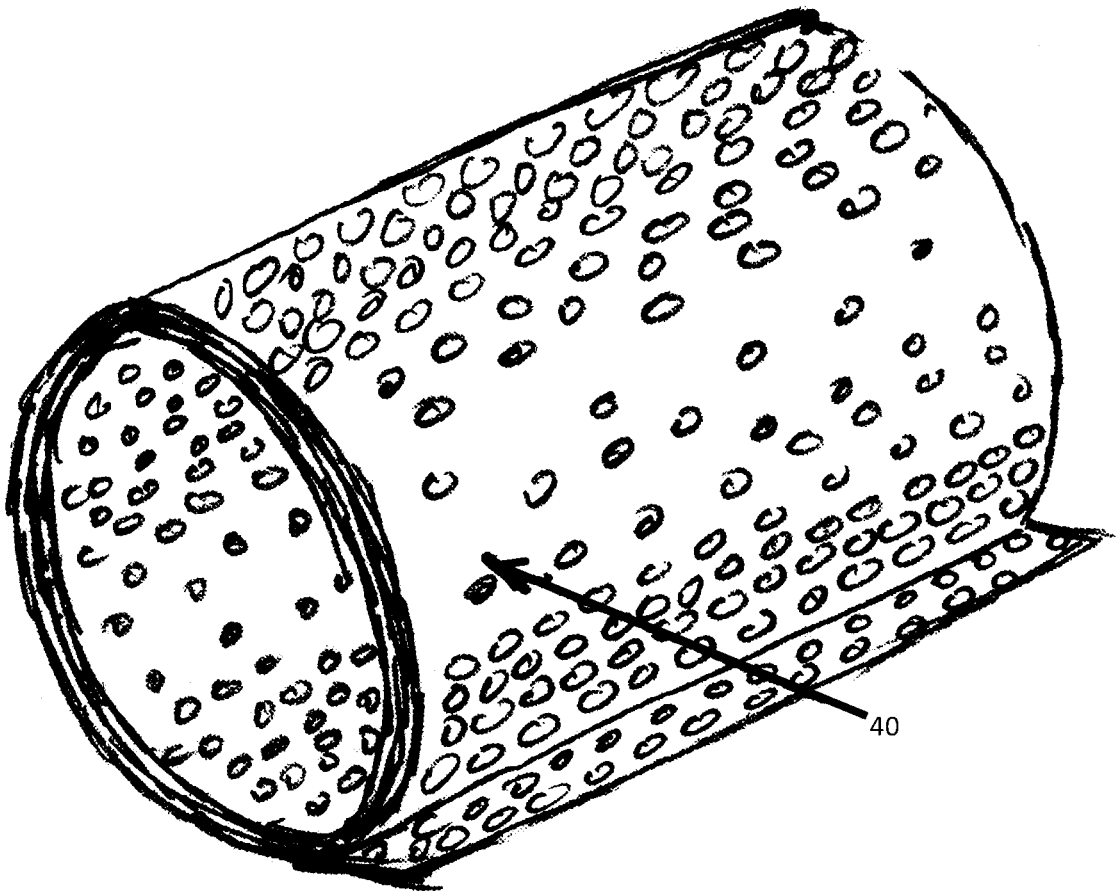
FIG. 8 is a perspective view of a single sheet of a crystalline lattice that is rolled to form the cylindrical fuel core of FIG. 7.

FIG. 8 is a perspective view that illustrates that one method for creating the stack of crystalline lattices 40 may be to create a single sheet of crystalline lattices 40 that is rolled into a cylindrical shape as shown. The efficiency of a cylindrical shape may or may not increase energy production of the energy generating system 30.

Figure 9:
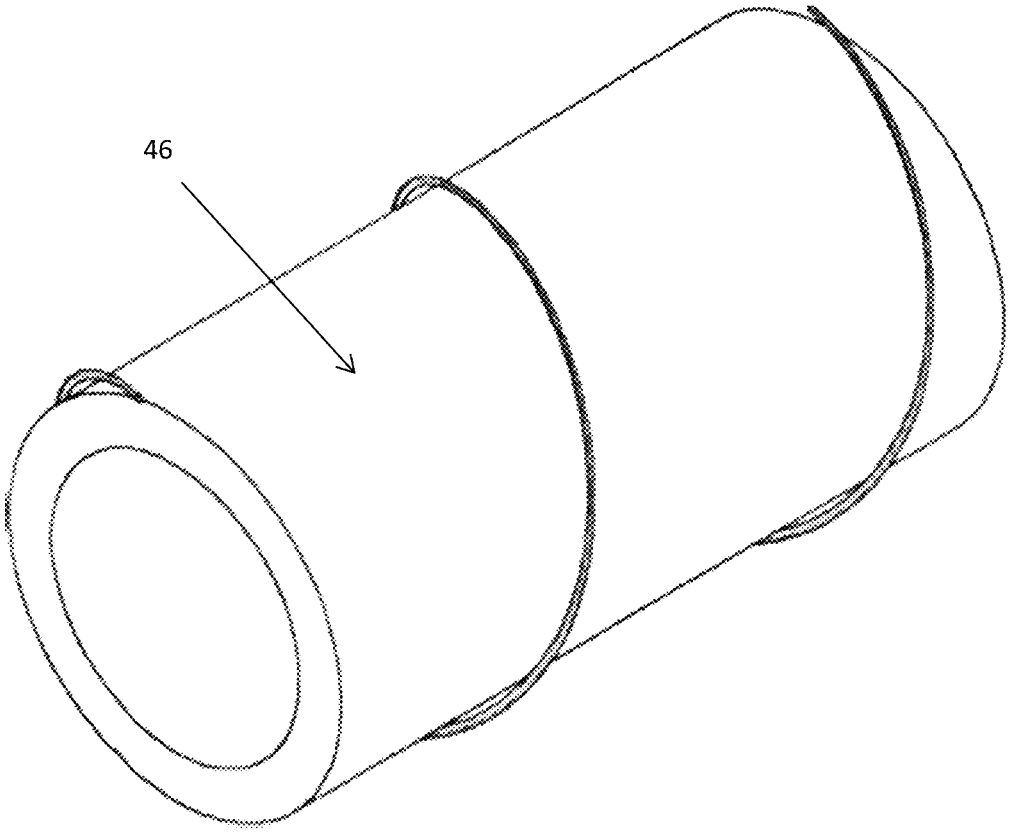
FIG. 9 is a perspective view of a helical structure for a design of the fuel core of the present invention.

FIG. 9 is a perspective view of another embodiment of the present invention, where sheets 46 that function as the crystalline lattices 40 are twisted together in a helical design of the fuel core 32. It should be understood that there are several layers of the crystalline lattices 40 that are twisted to form a multi-layer helical design of the fuel core 32.

One aspect of the present invention that may be useful to understand further is the path of the charged particles through the fuel core 32. The path followed by the charged particles through the fuel core 32 may or may not be linear. When the fuel core 32 is linear, the path is likely to be linear, but may not always be so. The shape of the path of the charged particles may conform to the shape of the fuel core 32, the plurality of crystalline lattices 40, or it may be different. The shape of the path may be determined by the plurality of electromagnets 34. For example, in a cylindrical fuel core 32, the path of the charged particles may be helical. The present invention may function as long as there is a path for the charged particles through the fuel core between the ends of the electron flow initiation system 38.

While the plurality of magnets 34 form the tunnel for the charged particles, and the tunnel may flow through the stack of crystalline lattices 40 of the fuel core 32, an electric field may be used to direct the flow of the charged particles through the tunnel. The direction of the flow of the charged particles may be changed by changing the electric field.

The electric field from the electron flow initiation system 38 that may be used to start and also to drive the current through the fuel core 32 may also provide excitation energy so that electrons in the plurality of radioactive isotopes 44 may reach the outer energy shell as the electromagnetic field may excite the decay rate of the plurality of radioactive isotopes. Thus, a magnetic field from the plurality of electromagnets 34 may concentrate the charged particles, while an electric field from the electron flow initiation system 38 may provide the direction of flow as the charged particles are harvested from the fuel core 32.

The decay rate of the plurality of radioactive isotopes 44 may also be influenced by pressure within the fuel core 32. Accordingly, another aspect of the present invention is to create the fuel core 32 such that the pressure within may be increased or decreased in order to control the decay rate. Therefore, the fuel core 32 may be sealed in order to control pressure within.

The concentration of the charged particles in the fuel core 32 may be affected by changing the characteristics of the plurality of electromagnets 34 that are also providing containment. Thus, the concentration of the charged particles may be influenced by the strength, position and size of the plurality of electromagnets 34, the strength of the electron flow initiation system 38, the volume of the fuel core 32, and the magnitude of the charged particles coming from the plurality of radioactive isotopes 44.

It should be understood that the electron flow initiation system 38 is attached at a first end 52 of the fuel core 32 to drive the electrons from the fuel core at a second end 54 to any electric load or system 50, including an electrical circuit, an electrical motor or an energy storage system such as a battery or capacitor.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. It is the express intention of the applicant not to invoke 35 U.S.C. §112, paragraph 6 for any limitations of any of the claims herein, except for those in which the claim expressly uses the words 'means for' together with an associated function.

What is claimed is:

1. A method for generating electricity using decaying radioisotopes, said method comprised of:

providing a fuel core comprised of alternating layers of a crystalline lattice formed only from a Dirac material and a layer of a plurality of radioactive isotopes held between the crystalline lattice layers;

receiving charged particles in the fuel core from a decay of the radioactive isotopes, including free electrons;

providing a drive regulation and containment system that is disposed around the fuel core for containing the charged particles from the radioactive isotopes, and for controlling a direction of current flow of the free electrons using the drive regulation and containment system; and providing an electron flow initiation system that is coupled to the fuel core for generating an electric field for causing a flow of current from the free electrons through the Dirac material of the fuel core.

2. The method as defined in claim 1 wherein the method further comprises coupling an electrical load to the Dirac material of the fuel core for receiving the flow of current.

3. The method as defined in claim 1 wherein the method further comprises providing a plurality of magnets as the drive regulation and containment system in order to compress the free electrons into a confined arrangement on the Dirac material of the fuel core.

4. The method as defined in claim 3 wherein the method further comprises utilizing at least one electromagnet as the plurality of magnets, to thereby compress the free electrons into an arrangement in the fuel core that facilitates the flow of the free electrons.

5. The method as defined in claim 4 wherein the method further comprises utilizing an electric field through the fuel core to thereby control a direction of flow of the free electrons.

6. The method as defined in claim 5 wherein the method further comprises utilizing an electromagnetic field to excite a decay rate of the radioactive isotopes to thereby increase the flow of the free electrons from the Dirac material of the fuel core.

7. The method as defined in claim 1 wherein the method further comprises providing a crystalline lattice of graphene as the Dirac material.

8. The method as defined in claim 1 wherein the method further comprises constructing the fuel core from a single fuel core layer of the Dirac material and the radioactive isotopes that are rolled to thereby create a cylindrical fuel core having a plurality of layers of the Dirac material and the radioactive isotopes.

9. The method as defined in claim 1 wherein the method further comprises constructing the fuel core from a single fuel core layer of the Dirac material and the radioactive isotopes that are twisted in a helical shape to thereby create a cylindrical fuel core.

10. The method as defined in claim 7 wherein the method further comprises scaling a size of the fuel core, wherein the size is scaled up by adding additional alternating layers of the crystalline lattice and of the radioactive isotopes, and the size is called down by removing selected ones of the alternating layers of the crystalline lattice and of the radioactive isotopes.

11. The method as defined in claim 7 wherein the method further comprises selecting a Dirac material from the group of Dirac materials comprised of Graphene, Bismuth-Antimony and Boron.

12. The method as defined in claim 1 wherein the method further comprises forming the fuel core as a two-dimensional or a three-dimensional shape.

13. A system for generating electricity using decaying radioactive isotopes, said system comprised of:

a fuel core comprised of alternating layers of a crystalline lattice formed only from a Dirac material and a layer of a plurality of radioactive isotopes held between the crystalline lattice layers, wherein the decay of the radioactive isotopes generates charged particles including free electrons in the Dirac material;

a drive system that is coupled to the Dirac material in the fuel core and which enables the free electrons to flow from the fuel core and generate a flow of current; and a containment system disposed around the fuel core for containing the charged particles from the plurality of radioactive isotopes, and for controlling a direction of current flow from the drive system.

14. The system as defined in claim 13 wherein the containment system is comprised of a plurality of magnets to thereby compress the free electrons on the Dirac material into a useful arrangement in the fuel core.

15. The system as defined in claim 14 wherein the plurality of magnets are comprised of at least one electromagnet.

16. The system as defined in claim 13 wherein the fuel core is comprised of a crystalline lattice of graphene as the Dirac material.

17. The system as defined in claim 13 wherein the Dirac material is selected from the group of Dirac materials comprised of Graphene, Bismuth-Antimony and Boron.

* * * * *